US006290025B1

(12) United States Patent
Lynn et al.

(10) Patent No.: US 6,290,025 B1
(45) Date of Patent: Sep. 18, 2001

(54) RAILROAD THEME RESTAURANT AND FOOD DELIVERY SYSTEM AND METHOD OF MAKING SAME

(76) Inventors: Terry S. Lynn; Robbin J. Hunt, both of 4906 Park Dr., Carlsbad, CA (US) 92008

( * ) Notice: Subject to any disclaimer, the term of this patent is extended or adjusted under 35 U.S.C. 154(b) by 0 days.

(21) Appl. No.: 09/562,068

(22) Filed: May 1, 2000

(51) Int. Cl.[7] ..... A45D 24/11
(52) U.S. Cl. ..... 186/46; 186/27; 186/34
(58) Field of Search ..... 186/45, 46, 48, 186/49, 27, 28, 30, 34

(56) References Cited

U.S. PATENT DOCUMENTS

| | | | | |
|---|---|---|---|---|
| 4,019,605 | * | 4/1977 | Kropf | 186/48 |
| 4,190,134 | * | 2/1980 | Kato | 186/46 |
| 5,145,090 | * | 9/1992 | Wyatt | 220/592.25 |
| 5,657,695 | * | 8/1997 | Lanoix et al. | 104/126 |
| 5,704,822 | * | 1/1998 | Nilsson | 104/130.01 |

* cited by examiner

*Primary Examiner*—Richard Chilcot
*Assistant Examiner*—Bryan Jaketic
(74) *Attorney, Agent, or Firm*—Richard D. Clarke

(57) ABSTRACT

A railroad theme restaurant with educational and entertainment aspects is provided, housed in a round building structure, having a model train food delivery system running on a network of model train tracks configured to service numerous seating modules for the rapid and accurate delivery of food orders to restaurant patrons. The model train food delivery system incorporates novel insulated insets to accommodate the transport of various food dishes and drink containers from a food preparation area to the dining tables. An inset storage area and loading dock facilitates the rapid loading of food orders and unloading of empty insets. Restaurant employees assume the titles, dress and mannerisms of railroad yard workers as they perform their regular duties adding to an overall interesting and fun atmosphere. The railroad track network is controlled by numerous electric switches and electronic sensors which detect the position of trains and direct the movement of food delivery train cars and returning trains. These switches and sensors may be microprocessor or manually controlled to accurately and efficiently direct train movement during operation. Track networks are assessable through access corridors for rapid and discreet repair and routine maintenance of track.

22 Claims, 9 Drawing Sheets

RAILROAD THEME RESTAURANT AND FOOD DELIVERY SYSTEM AND METHOD OF MAKING SAME

BACKGROUND OF THE INVENTION

1. Field of the Invention

The present invention relates to a new and improved restaurant food delivery system and method of making same. More particularly, the present invention relates to a system of food distribution which utilizes electronically controlled g-gauge model railroad train sets fitted with customized novel food tray insets developed for enabling food delivery to restaurant patrons by model railroad train cars. A computerized system facilitates information transmittal to staff and personnel of the restaurant, train configuration and routing, and maximizes efficiency in the delivery of food to tables. The entertainment aspect of the restaurant consists of informative and entertaining properties of the restaurant and personnel and the floor plan and resulting restaurant building design is a "roundhouse" restaurant structure.

2. Description of the Related Art

Today's modern family is often going in separate directions for dining and entertainment. With increasing demands placed on children and adults for free time, opportunities for family outings require multi-dimensional facilities for providing a complete affordable dining and entertainment experience.

The concept of restaurant food delivery systems as well as multi-use building structures for restaurants are well known. Examples of different types and kinds of methods for restaurant food delivery systems and building structures are disclosed in U.S. Pat. Nos. 5,839,115, 5,775,033, 5,636,710, 4,019,605 and 3,673,967.

In general, the structure and function of most restaurant food delivery systems involves taking and handling of orders as well as food delivery by personnel or staff of a restaurant. A limited number of restaurants utilize mechanical, computerized or automated systems to facilitate this ordering and food delivery.

An automated system for restaurant management providing for limited ability of patrons to order using an interactive computer terminal and system is known in the prior art. Such a device is described in U.S. Pat. No. 5,839,115. The patron orders from the interactive menu and receives information concerning approximate time of their food order delivery. While such a computerized system is helpful in coordination of food delivery, and facilitates information transfer efficiently throughout the restaurant delivery system, there is no provision which would allow for direct communication from the patron to the restaurant personnel for information that is not present on the selected computerized menu. The system does not provide for human interaction and attention to the specific needs, questions or concerns of the restaurant patrons.

Additionally, in order for the patron to benefit from the computerized system, the patron must be somewhat familiar with the technology and feel comfortable utilizing it or the experience might be intimidating or frustrating. No provision is made for human instruction or assistance for those patrons requiring assistance. This could very likely result in a loss of revenue for the restaurant employing such a system.

Therefore, it would be highly desirable to have a new and improved restaurant food delivery system which would allow for computerized communication of food orders to be conveyed to the personnel and staff of the restaurant, enabling efficient delivery of accurate food orders, while also allowing human interaction for addressing the specific questions, wants or needs of the restaurant patron.

The building structure described in U.S. Pat. No. 5,775,033 addresses the requirements of providing areas of entertainment for patrons in the same building housing a family restaurant. This system provides for a play area, primarily for children, while adult patrons may enjoy dining without being disturbed by the noise and confusion of the play area.

The separation of adults and children does not facilitate interactive entertainment for the entire family. Bonding between children and parents while participating in a mutually enjoyable experience is not likely to occur when the entertainment aspects of the restaurant specifically geared toward children are so clearly delineated from the dining areas.

In addition, the frenetic physical activity provided for children may not be conducive to the relaxation of adults, and proper digestion of meals when occurring just prior to or after ingestion of a meal. Moreover, the educational or informational aspect of such an environment is somewhat limited by the aforementioned family separation.

Therefore, it would be highly desirable to have a new and improved, interesting and entertaining restaurant food delivery system, which would provide for an enjoyable and informative form of entertainment in which both adults and children could actively participate in and enjoy while dining out together as a family unit.

U.S. Pat. No. 5,636,710 describes a food delivery system for restaurants that addresses the problem of fast and efficient food delivery to the patron. However, the device utilizes a pneumatic delivery system for delivery of food and drinks. While this type of delivery may function well for sandwiches and other foods which may be appropriately packaged for fast food settings, carbonated drinks, hot drinks and a complete multiple course meal delivery, very often required by full service restaurants, would be highly problematic in such a delivery system. The random circular movement of the pneumatic container coupled with sudden starts and stops would make delivery of non-packaged food significantly impractical.

Furthermore, this system was developed specifically to minimize the need for restaurant personnel who would attend to the individual needs and concerns of patrons and does not provide any entertainment or educational aspect to the delivery of restaurant food.

Therefore, it would be highly desirable to have a new and improved restaurant food delivery system which would provide for communication to the restaurant personnel and staff while providing a means of food delivery which would incorporate both efficiency, education and entertainment for the patrons, while also enabling restaurant personnel to address and attend to the individual needs, questions and concerns of restaurant patrons.

U.S. Pat. No. 5,582,567 describes a food delivery system for restaurants that utilizes a mechanized food delivery system which includes a food container, an elevated conveyor track and an elevator tray which lowers the food to the level of accessibility to patrons. This system provides a novel mechanism for food delivery but utilizes an extremely complex and costly apparatus for delivering the food, lowering the food to the level accessible to the patrons and accomplishing such food delivery without the use of restaurant personnel.

The complexity of the mechanism would make it likely that some portion of the system would require servicing on a routine basis and the unexpected malfunctioning of one portion of the system could render the entire system temporarily non-functional since the delivery of food from the mechanized elevated conveyor to the correct station requires perfect functioning of each of the elevator trays at each station in a sequential fashion.

In addition, the absence of restaurant personnel available to patrons would again fail to address the problem of human interaction and attention to the individual needs, questions and concerns of patrons, possibly leading to frustration and loss of restaurant revenue.

Therefore, it would be highly desirable to have a new and improved restaurant food delivery system which would allow uninterrupted service to all of the patrons of a restaurant by means of a cost effective, simple, efficient and effective food delivery mechanism which would be easily maintained and could act independently of any potential malfunctions at any given station.

Furthermore, it would be highly desirable if such a food delivery system incorporated the use of restaurant personnel or staff available to address the individual needs, questions and concerns of patrons, while also enabling an entertaining and educational dining experience for the entire family.

Finally, U.S. Pat. No. 3,673,967 provides for a conveyor system for restaurant food delivery. This system does address the problem of sequential food distribution in the event of station malfunction, however, the mechanism of delivery is still somewhat complicated and therefore would require skilled technical servicing in the event of any such mechanical malfunction. The somewhat elaborate and involved mechanical conveyor system would be expensive and difficult to install and maintain properly which could require frequent repairs or mandate numerous adjustments, and would necessarily require extensive and frequent maintenance.

In addition, the system was conceived primarily as a means to replace restaurant staff or personnel who attend to and address the individual needs, questions and concerns of the patrons as well as collect money and tips and return change, and not necessarily to contribute to an educational and entertaining atmosphere of a family restaurant.

Therefore, it would be highly desirable to have a new and improved restaurant food delivery system which is inexpensive to install and maintain, would enable the efficient and accurate delivery of food orders, and which would also allow for availability of restaurant staff or personnel to attend to and address the individual needs, questions and concerns of the restaurant patrons, while contributing to an overall amusing, enjoyable and informative experience for family entertainment.

SUMMARY OF THE INVENTION

Therefore, the principal object of the present invention is to provide a new and improved restaurant food delivery system and building structure and method for making same which would provide a complete entertainment, informational and interactive experience in family dining. Moreover, the principal object of the present invention is to provide a new and improved restaurant food delivery system consisting of four major novel inventive aspects to accomplish this end. The novel inventive aspects consist of an electronically controlled g-gauge model railroad train set food delivery system, a novel food tray configuration developed for food delivery by means of the model railroad train, a novel amusement and entertainment aspect of the restaurant consisting of informative and entertaining properties of the restaurant and personnel, and the floor plan and resulting restaurant building design for the "roundhouse" restaurant structure.

It is a further object of the present invention to provide such a new and improved restaurant food delivery system and building structure and method for making same that incorporates a novel inventive aspect consisting of a model railroad train food delivery system which would be simple to install and maintain. In this method of restaurant food delivery, scale model trains using several independent track networks would be used to deliver the meal to the tables. The use of model trains for food delivery would be consistent with the railroad train theme entertainment while providing an interactive efficient and rapid means of accurate food delivery to restaurant patrons.

It is yet a further object of the present invention to provide such a new and improved method of restaurant food delivery system and building structure and method for making same in which food is delivered using a novel food tray configuration developed for food delivery by means of the model railroad train. The novel inventive aspect consists of a number of different specialized food tray configurations which will be customized to each separate food item ordered for efficient and effective transportation via the model trains used for food delivery to the dining tables.

It is a further object of the present invention to provide such a new and improved restaurant food delivery system and building structure and method for making same that incorporates a novel inventive aspect which further enhances the entertainment aspect of the restaurant utilizing informative and entertaining properties of the restaurant and personnel. This integrated entertainment experience will include, but not limited to, train memorabilia, railroad yard titles, dress and mannerisms of restaurant personnel, railroad theme language used and interactive and informative displays and presentations, working model trains, menus and placards, gift shops, memorabilia and a railroad theme museum.

It is yet another object of the present invention to provide such a new and improved restaurant food delivery system and building structure and method for making same utilizing a unique floor plan and resulting round building design for the "roundhouse" restaurant structure. This floor plan accommodates the system of g-gauge and other scale model trains using several independent track networks which would be used to efficiently and accurately deliver ordered meals to the dining tables.

Briefly, the above and further objects of the present invention are realized by providing a total interactive entertainment experience for family dining by using the aforementioned four novel inventive aspects. Patrons will be surrounded by train memorabilia, signs, video and audio presentations and model railroads which will be available to patrons to operate. The theme will be so pervasive that the restaurant will be an interactive place to experience the history of trains.

One of the novel inventive aspects consists of a food delivery system. This system utilizes a model train and several independent track networks for food delivery to patrons seated at dining tables. The use of independent track networks allows the system to continue to operate efficiently even if one of the tracks becomes unavailable for use at any given time. The use of model trains provides for economical and convenient set-up of the delivery system, flexibility in configuration of the system, readily available replacement parts for the delivery system, as well as ease of use and operation. This system also employs electronic and computerized instructions which control and organize orders and eventual food delivery to restaurant customers by transmitting orders, destination, configuration of food trays, food to be delivered and other information relating to the delivery of food by means of the model railroad train to restaurant personnel and staff. In addition, the designated responsibilities of the staff and personnel of the restaurant contribute to the overall function and atmosphere of the experience. A "station master" greets patrons, assesses seating availability, assigns the station, and provides the conductor with a seating card. A "conductor" seats passengers and gives orientation and instruction. An "engineer" takes the meal order and enters the order into the computer system. The "yardmaster" prepares the train and tray insets according to the computerized instruction. The kitchen or "lizard scorchers" prepares the order and informs the engineer via a two-way radio communication system when the meals are ready. The engineer oversees the loading of the appropriate beverages, plates or meals. The "dispatcher" is notified of train number, track number and station name and provides clearance to the yard. The engineer then proceeds to the station (dining table) to assist restaurant patrons in unloading the ordered food.

Another novel inventive aspect is comprised of a novel food tray configuration developed for food delivery by means of the model railroad train. The tray configuration is adaptable to the specific requirements of each order, the unitary inset attaches to the train car and the food or drink container with a snug fit to prevent spills. The appropriate inset to be used in a given food order is transmitted to the proper restaurant personnel by computer upon placement of the order for food.

A third novel inventive aspect involves the entertainment side of the restaurant consisting of informative and entertaining properties of the restaurant and personnel. The railroad theme is carried forth through the titles, dress and manner of behavior of the personnel, informative videos, interactive computer terminals and a museum as well as model trains which will be available to the patrons for use in the lobby and other sections of the restaurant. All selections on the menu will be named after famous trains, engineers, famous train lines and even train robbers, and computer terminals will be available to access global computer network available train sites and provide other train related information.

Another novel inventive aspect consists of the unique floor plan and resulting restaurant round building design for the "roundhouse" restaurant structure which is designed to function in conjunction with the novel model train food delivery system. The building design also accommodates a gift shop, museum, interactive audio and visual displays a lobby area with working model trains accessible to patrons waiting to be seated as well as the restaurant dining area.

BRIEF DESCRIPTION OF THE DRAWINGS

The above mentioned and other objects and features of this invention and the manner of attaining them will become apparent, and the invention itself will be best understood by reference to the following description of the embodiment of the invention in conjunction with the accompanying drawings, wherein.

DESCRIPTION OF THE PREFERRED EMBODIMENTS

Figure 1:
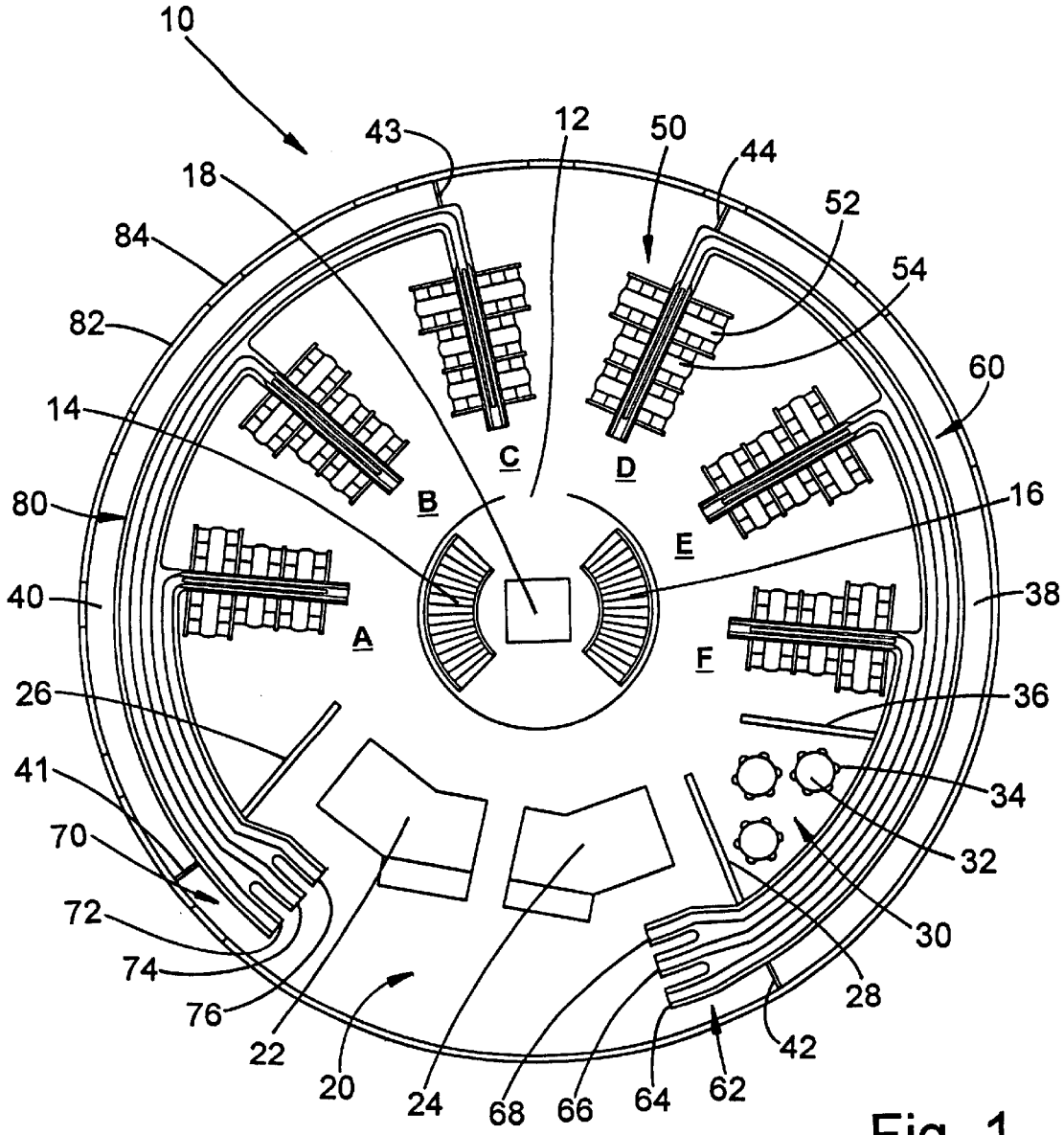
FIG. 1 is a plan view of the round restaurant building illustrating the level two floor plan with kitchen area, seating area and restrooms, for a typical railroad theme restaurant constructed in accordance with the present invention.

Referring now to the drawings, and more particularly to FIG. 1 thereof, there is shown a new restaurant food delivery system and building structure and method for making same, specifically, the entire level two dining area plan view when built in a roundhouse format 10 constructed in accordance with the present invention. The new plan view of the Roundhouse restaurant design level 2 dining area 10 is used to efficiently and effectively provide a complete entertainment, informational and interactive experience in family dining by incorporating train memorabilia, a model train delivery system, and a general railroad theme carried through the restaurant staff manner, language and dress.

Referring to FIG. 1, the novel plan view of the roundhouse design level two dining area 10 where diners enter the main entry 12 into the dining area by means of one of two stairwells 14 and 16 or by means of an elevator 18. The kitchen area 20, the men's room 22 and ladies' room 24 are separated from the dining area by means of partition walls, 26 and 28. A private party dining module 30 contains a plurality of tables as exemplified by table 32 and a plurality of chairs as exemplified by chair 34 and is separated from the general dining areas by a partition wall 36.

Access corridors 38 and 40 allow restaurant personnel to service model train delivery lines and trains and are accessible by means of corridor access doors 41, 42, 43, and 44.

Several seating modules are provided for diners A, B, C, D, E, and F as exemplified by seating module 50. The seating modules consist of a large table which accommodates six to eight patrons and is exemplified by a large table 52. Adjacent to the large table 52, are two smaller tables which seat two to four diners as exemplified by small table 54.

Each seating module 50 is serviced by two dedicated delivery lines 60 which provide access for model trains. Restaurant personnel place food, plates, cups onto appropriate trains for delivery to the table at loading dock areas 62 and 70. Loading dock area 62 provides railroad restaurant personnel with a staging location to load and unload food and beverages on trains which are routed on the incoming and outgoing delivery service line 64 bound for seating module D, the incoming and outgoing delivery service line 66 bound for seating module E and the incoming and outgoing delivery service line 68 bound for seating module F. Loading dock area 70 provides loading of food and beverages on trains traveling on delivery lines 80 to the other half of the individual seating modules 50. The delivery lines 80 consist of the incoming and outgoing delivery service line 72 delivering food and beverages to seating module C, the incoming and outgoing delivery service line 74 on route to seating module B and the incoming and outgoing delivery service line 76 on route to seating module A.

A plurality of windows are intermittently spaced about the periphery of the novel plan view of the Roundhouse restaurant design level 2 dining area as exemplified by window 82. Supportive wall columns as exemplified by wall column 84 are inter-spaced between windows.

Figure 2:
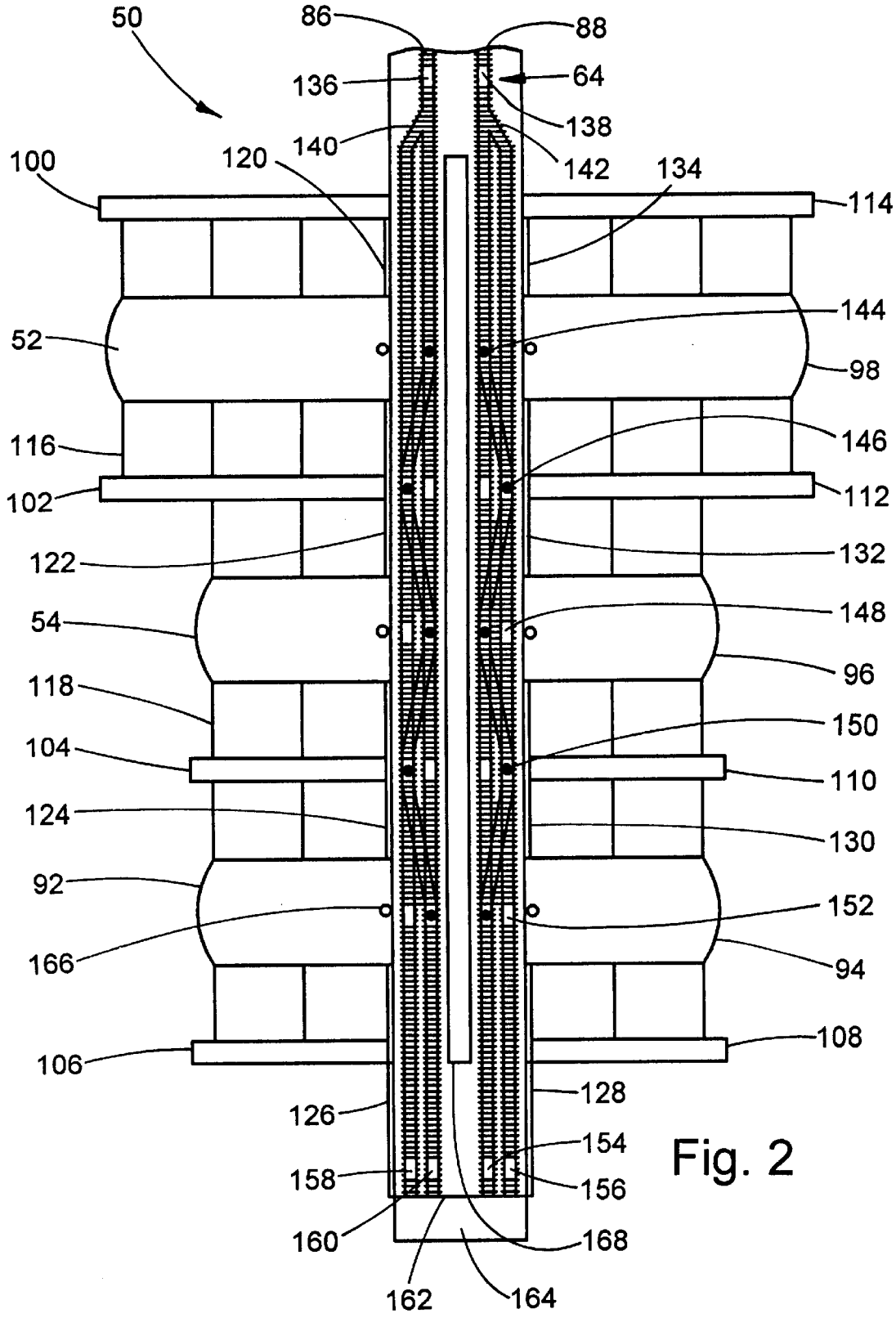
FIG. 2 is an enlarged top view of a restaurant seating area single seating module, constructed in accordance with the present invention.

Turning now to FIG. 2 to illustrate an enlarged top view of a single seating module 50, the main lines from the loading bays 86 and 88 provide access for the model trains to the single seating module 50. One side of the single seating module 50 has a large table with seating area 52 and two small tables with seating 54 and 92. A mirror image of this arrangement is seen on the other side of the single seating module 50, with one large table with seating area 98 and two small tables with seating 94 and 96. The tables with seating are separated from surroundings by seating partition walls, 100, 102, 104, 106, 108, 110, 112, and 114. A typical large table seating 116 will accommodate two to three diners on each side of a large table with seating 52. A typical small table seating 118 will accommodate one to two diners on each side of a small table with seating 54.

The typical large table seating 116 and typical small table seating 118 are separated from the main lines 86 and 88 and siding delivery tracks 140, 142 by sneeze guards/shields 120, 122, 124, 126, 128, 130, 132, and 134. The length of the table space nearest the siding delivery tracks 140 and 142 will remain without obstructions by sneeze guards or walls for access to trains from the table.

Switching of trains from main lines 86 and 88 to and from siding delivery tracks 140 and 142 is controlled by a computer utilizing electronic sensor/switches as exemplified by 144, 146, and 150, and electric sensors only as exemplified by 148 and 152, which are embedded in the main lines 86 and 88 and siding delivery tracks 140 and 142. As described below, these electronic sensor/switches and sensors only are strategically placed at the cross-over points as well as the siding line and allow two trains to operate on a single line to ensure quick delivery and prevent trains from colliding.

An end of line bumper 162 prevents accidental over-run by model trains past the ends of the main lines 86 and 88 and siding delivery tracks 140 and 142. The service counter 164 provides access to the model trains for railroad restaurant personnel.

Each table is provided with two way radio communicators as exemplified by two way radio communicator 166 which provides efficient communication between restaurant personnel and dining restaurant patrons.

A central partition wall 168 separates each half of the seating module 50 which reduces noise and helps to maintain privacy for diners.

Figure 3:
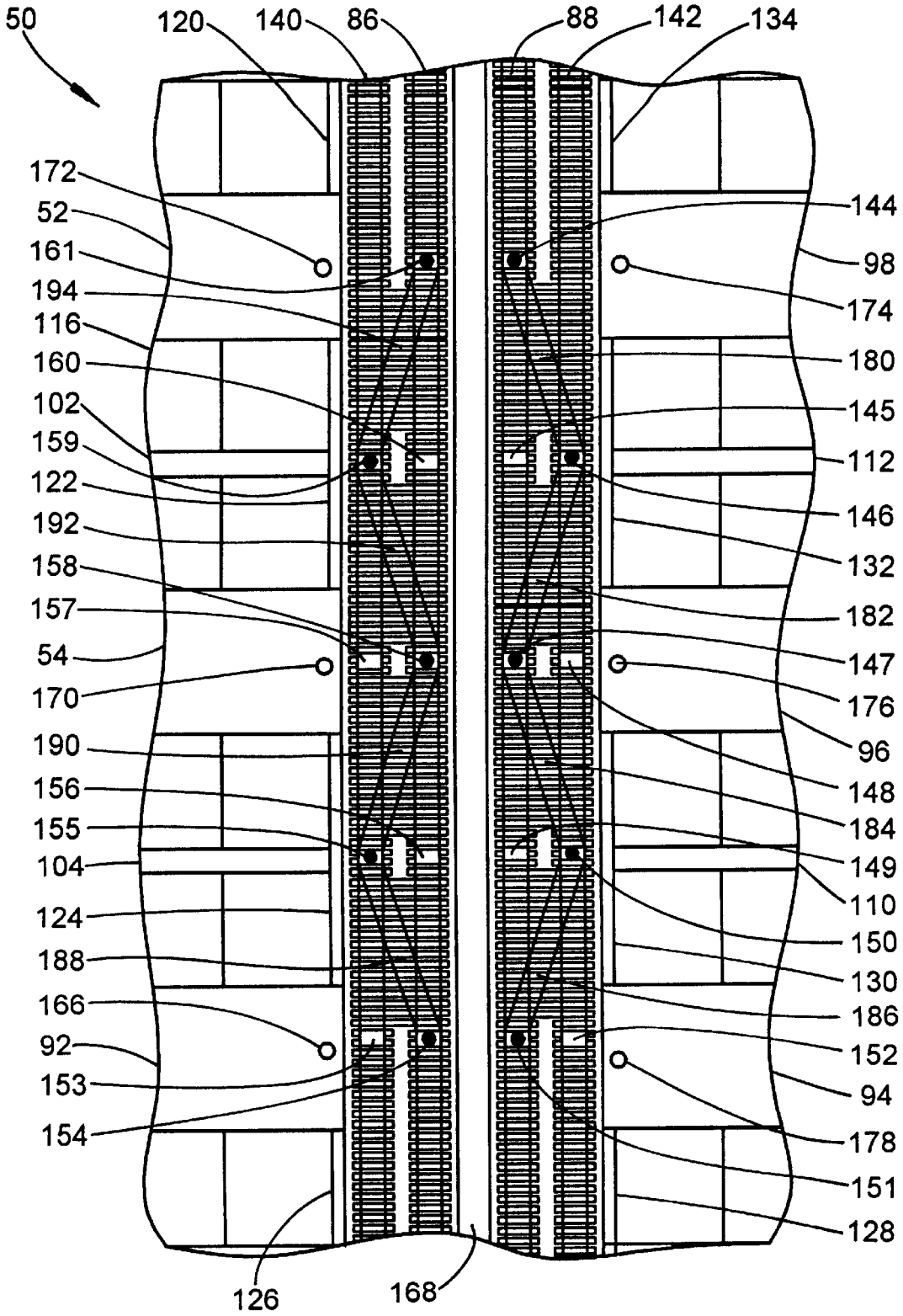
FIG. 3 is a partial greatly enlarged top view of the single seating module area shown in FIG. 2, illustrating details of the electronic sensors, electronic switches and two-way communication radios, constructed in accordance with the present invention.

Referring now to FIG. 3, this partial greatly enlarged top view of seating module 50 illustrating main lines from the loading dock bay 86 and 88. Each seating module has one or more small tables with seating on each side as exemplified here by small tables with seating 92, 94 and 96. Additionally, each seating module 50 has one or more large tables with seating as exemplified here by large table with seating 98. Seating partition walls 100, 102, 104, 106, 108, 110, 112 and 114 are located between the typical large table seating 116 and the typical small table seating 118 to provide privacy and exclude ambient noise. Sneeze guard/shields 120, 122, 124, 126, 128, 130, 132 and 134 are located between typical large and small table seating 116 and 118 and the main lines 86 and 88 from the loading dock bay. The sneeze guard/shields 120, 122, 124, 126, 128, 139, 132 and 134 reduce ambient noise levels in the typical large and small seating areas 116 and 118, protect diners from possible accidental spills and reduce particulates which may contaminate transported food.

FIG. 3 also illustrates a portion of the control mechanisms for train delivery. The combination electronic sensors/switches 144, 146, 147, 150, 151, serve main line 88 and siding line 142, while combination electronic sensors/switches 161, 159, 158, 155 and 154 serve main line 86 and siding line 140, and are strategically placed at the switch points as well as the end of the line on the main lines 86 and 88 from the loading dock bay and the siding delivery tracks 140 and 142. Electric sensors (sensors only no switch) 145, 148, 149, and 152 serve main line 88 and siding line 142, while electric sensors (sensors only no switch) 160, 157, 156, and 153 serve main line 86 and siding line 140. This arrangement of combination sensor/switches and sensors enable microprocessor control or manual control, thereby allowing two trains to operate on a single line to ensure quick delivery and prevent trains from colliding by determining exact positions of each train and allowing electronic control of train routes. Cross-overs 180, 182, 184, 186, 188, 190, 192 and 194 allow train routes to be switched between main lines 86 and 88 from the loading dock bay and the siding delivery tracks 140 and 142 at appropriate tables. For example, cross-over 180 allows redirecting the train from electronic sensor/switch 144 to the point at electronic sensor/switch 145 or the train may proceed ahead on the main line 88 to intersect sensor only 145. This redirecting of the train or allowing the train to remain on the main line is also true for all other sensor/switches and sensor only points, respectively. In this way, each cross-over allows the train to deliver a food order directly to the correct table without passing by any other table before delivery of the food order. The main line and siding line work together to achieve this result. After delivery the train reverses direction and returns to the loading dock area. Each line functions independently on its respective side of the central partition wall 168.

In addition to electronic control of switching, FIG. 3 also illustrates the two way radio communicators 166, 170, 172, 174, 176 and 178 which allow communication between the diners and the restaurant personnel if needed.

Figure 4:
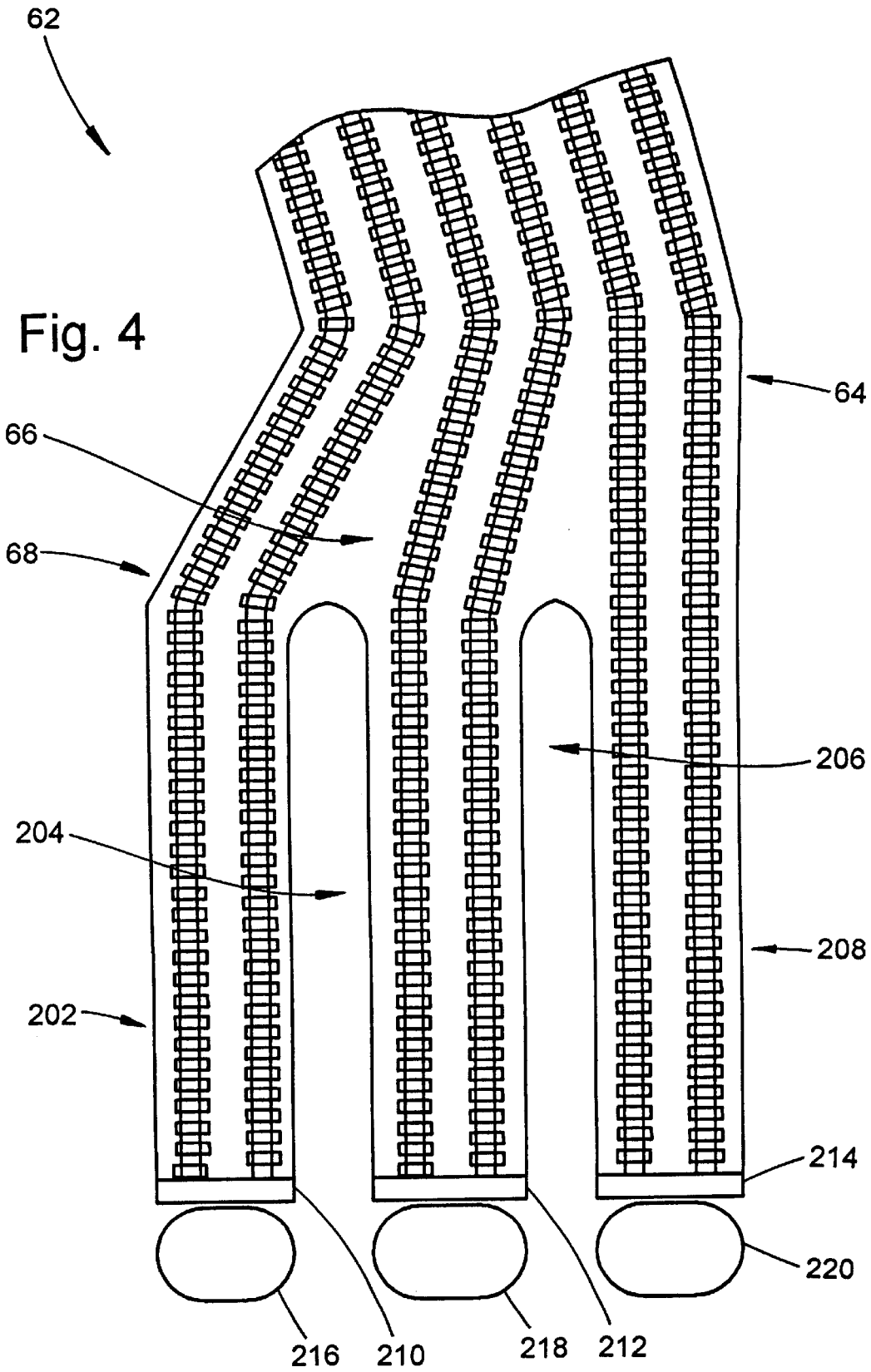
FIG. 4 is a top view of a model train loading dock area facilitating the loading and unloading of the model train for food delivery to seating modules, constructed in accordance with the present invention.

Turning now to FIG. 4, a greatly enlarged view of the loading dock area 62, which shows the terminal portions of incoming and outgoing delivery service lines 64, 66 and 68. Restaurant personnel have easy and convenient access to incoming and outgoing delivery service lines 64, 66 and 68 by means of the loading access areas 202, 204, 206 and 208 for cleaning and reloading food orders onto trains. The end of line bumpers 210, 212 and 214 prevent accidental over-run by trains. Disposal bins 216, 218 and 220 for holding used insets for delivery to the kitchen for cleaning or disposal, are located at the ends of the incoming and outgoing delivery service lines 64, 66 and 68.

Figure 5:
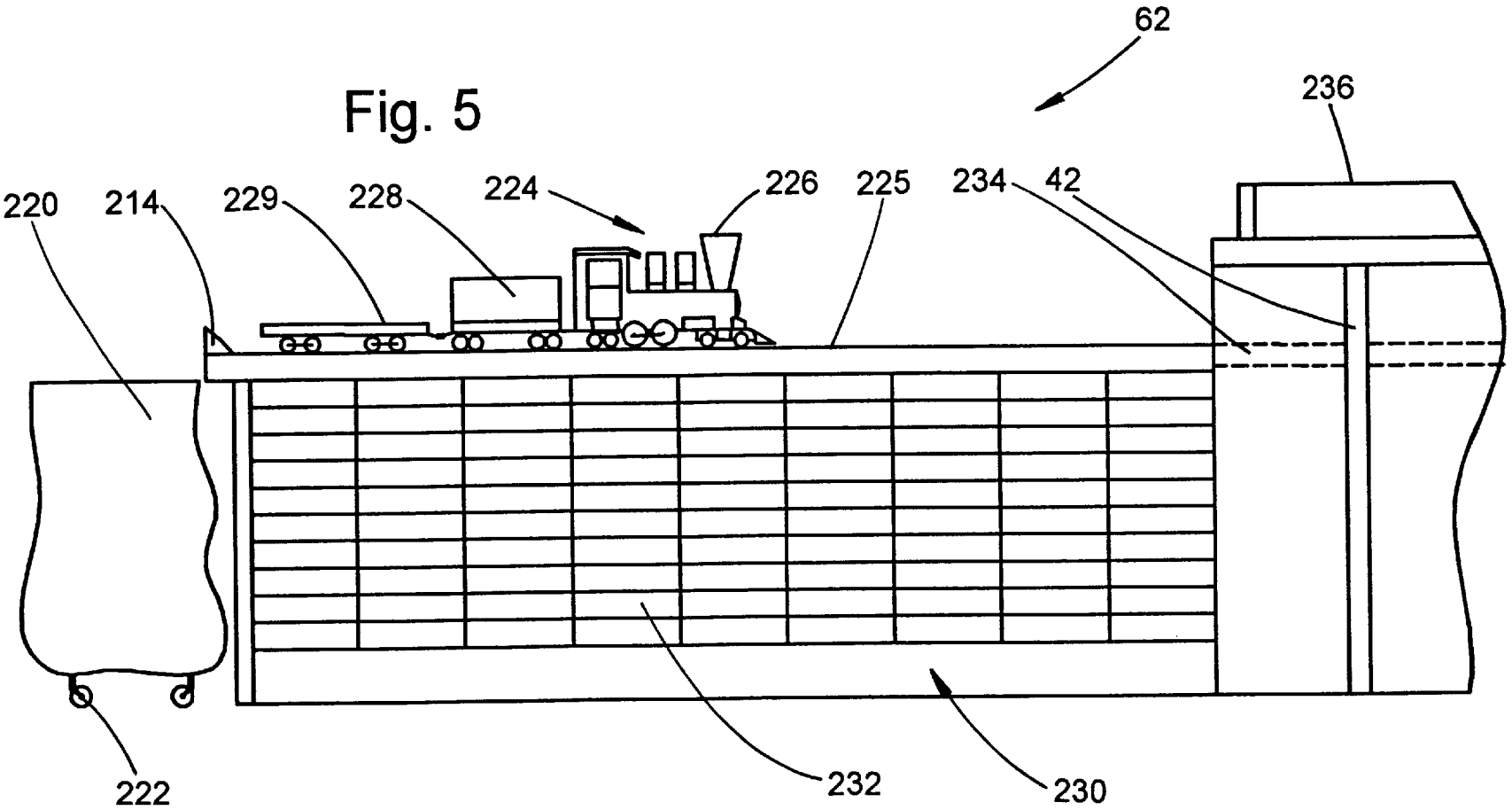
FIG. 5 is a side elevational view of the model train loading dock area shown in FIG. 4, illustrating the customizable inset storage area, constructed in accordance with the present invention.

FIG. 5 is a side view of the loading dock area 62. The disposal bin 220 is mounted on a number of rollers as exemplified by roller 222 for easy transport of used insets for cleaning or disposal. The end of line bumper 214 prevents accidental over-run by trains at the end of the track. An example of a one configuration of a delivery train on tracks 224 is comprised of the locomotive 226, coal car 228, flat car 229. The train is placed on the track surface 225 of the loading dock area 62.

The storage shelving array for insets 230 is located below the track surface 225. A plurality of storage shelves, as exemplified by individual storage shelf for insets 232, constitute the storage shelving array for insets 230. Slidable trays for cleaning under the track 234 catch any spillage from incoming and outgoing trains for quick and effective cleaning underneath the delivery tracks 225. A portion on a sneeze guard, front side 236 dampens ambient noise and reduces particulates which may contaminate food during delivery. The corridor access door 42 provides access to restaurant personnel for servicing of trains, tracks and slidable trays for cleaning under track 234.

Figure 6:
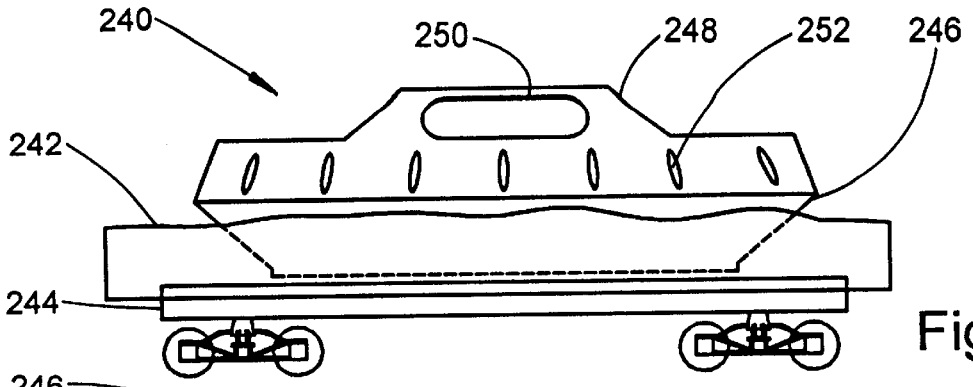
FIG. 6 is a side elevational view of one embodiment of the customizable inset in place on a flat car, holding a single entry plate with lid, constructed in accordance with the present invention.

Referring now to FIG. 6, a single dish flat car inset 240 is illustrated. A unitary inset 242 made from a durable, re-usable, easily cleaned material such as plastic will fit snugly over the top of a standard flat car 244. The unitary inset is molded in such a manner as to provide a snug setting for a food plate 246 being delivered via the train, provides insulation for keeping the food in the dishes from changing temperature, keeps the train cars clean in the event of spills and provide natural ballast to the train cars that are being pulled by the engine. Each food plate 246 is provided with a vented custom cover (plate lid) 248 from with a lid handle 250 and a plurality of vents as exemplified by vent 252. The vented custom cover 248 keeps the food warm and prevents particulates from contaminating food during delivery. The lid handle 250 facilitates placement and removal of the vented custom cover 248 on the food plate 246. The vented custom cover 248 may be made from a clear reusable or disposable material for viewing of the menu offerings by diners as the food items are being transported.

Figure 6A:
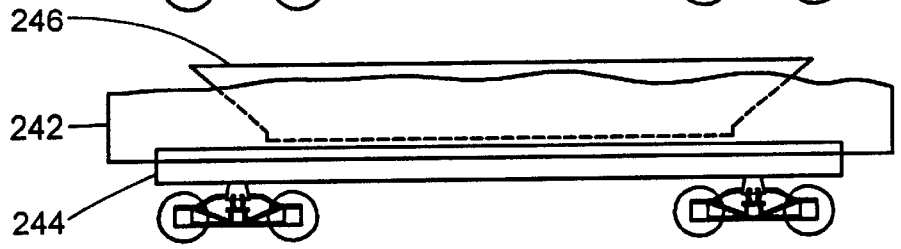
FIG. 6*a* is a side elevational view of the embodiment of the customizable inset shown in FIG. 6, in place on a flat car, holding a single entry plate without a lid, constructed in accordance with the present invention.

FIG. 6*a* shows the single dish flat car inset 240 on a flat car 244 with the food plate 246 and without the vented custom lid 248 to more clearly differentiate the food plate 246 from the vented custom cover 248.

Figure 6B:
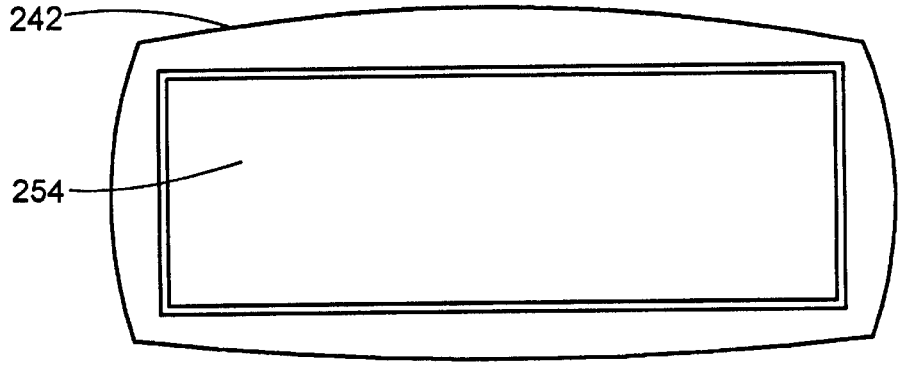
FIG. 6*b* is a bottom view of the customizable inset shown in FIG. 6, constructed in accordance with the present invention.

Further details of the novel unitary inset 242 are shown in FIG. 6*b* which shows the molded bottom to fit flat car top surface 254. This view shows how the molded portion of the bottom of the single dish flat car inset 240 is designed to fit snugly around the edges of the standard flat car 244.

Figure 6C:
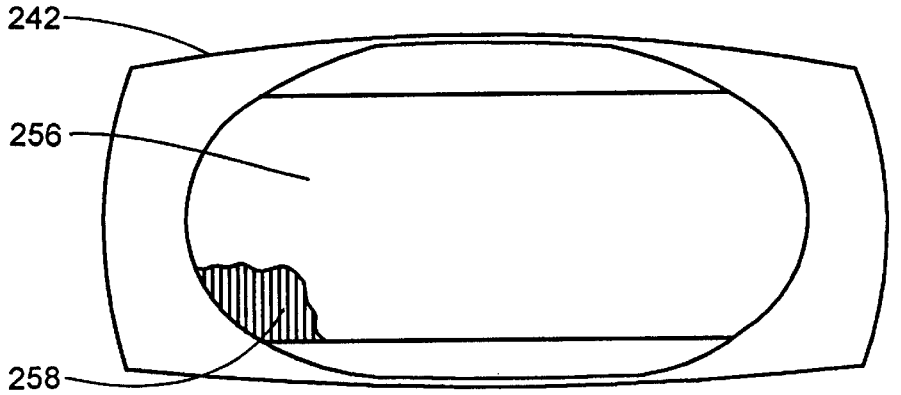
FIG. 6*c* is a partially cut away top view of the customizable inset shown in FIG. 6, constructed in accordance with the present invention.

FIG. 6*c* is a top view of the unitary inset 242 with a partial cut away showing the top of the flat car 258. This top view clearly shows the molded top with a cut-away portion 256 to accept a plate.

Figure 7:
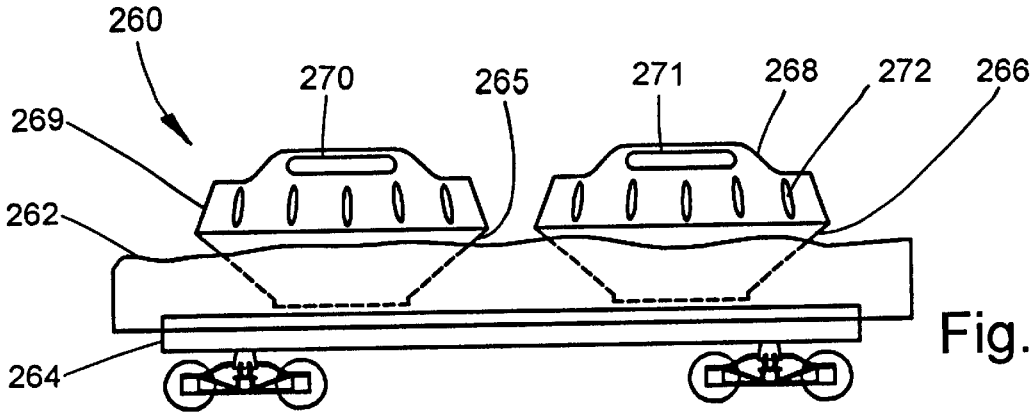
FIG. 7 is a side elevational view of another embodiment of the customizable inset in place on a flat car, holding two side dish plates with lids, constructed in accordance with the present invention.

Turning now to FIG. 7, there is disclosed a novel 2 dish flat car inset 260. The unitary inset 262 is made from a moldable, durable, re-usable material and is mounted on a standard flat car 264. Two dishes for side orders 265 and 266 are cradled in the molded top portion of the unitary inset 262. The dishes for side orders 265 and 266 each have a fitted lid 269 and 268 with handles 270 and 271 and vents as exemplified by 272, which protect the food from contaminating particulates and which help to maintain the food at a desired temperature. The lid handles 270 and 271 facilitate placement on and removal of the fitted lids 268 and 269 with handles and vents from the dishes for side orders 265 and 266. The numerous vents in the lid, as exemplified by vent 272, allow escape of steam from the hot food and help prevent injury due to steam burns, and keeps the food free from airborne contamination, including particulates.

Figure 7A:
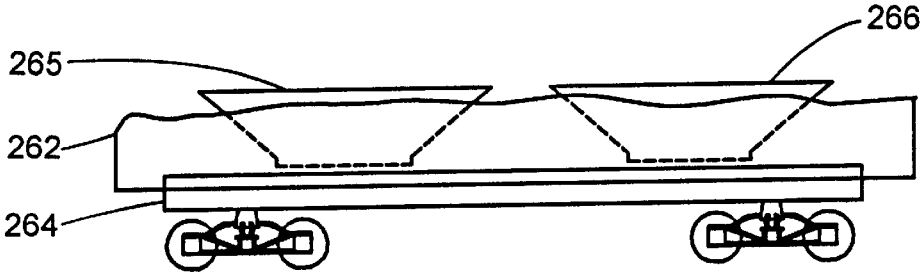
FIG. 7*a* is a side elevational view of the embodiment of the customizable inset shown in FIG. 7, in place on a flat car, holding two side dish plates without lids, constructed in accordance with the present invention.

FIG. 7*a* shows the unitary inset 262 with the two dishes for side orders 265 and 266 without the fitted lids 268 and 269 with handles and vents as it would appear when mounted on a standard flat car 264.

Figure 7B:
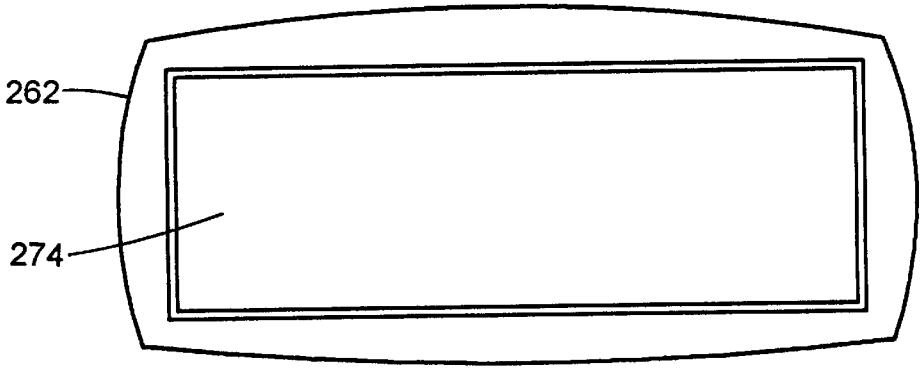
FIG. 7*b* is a bottom view of the customizable inset shown in FIG. 7, constructed in accordance with the present invention.

The bottom portion of the molded inset bottom to fit a flat car 274 is seen in FIG. 7*b*. The unitary inset 262 is molded on the bottom portion to fit snugly on the top of a standard flat car 264 to provide a sturdy, tight friction fit to prevent accidental shifting of the dishes for side orders 265 and 266.

Figure 7C:
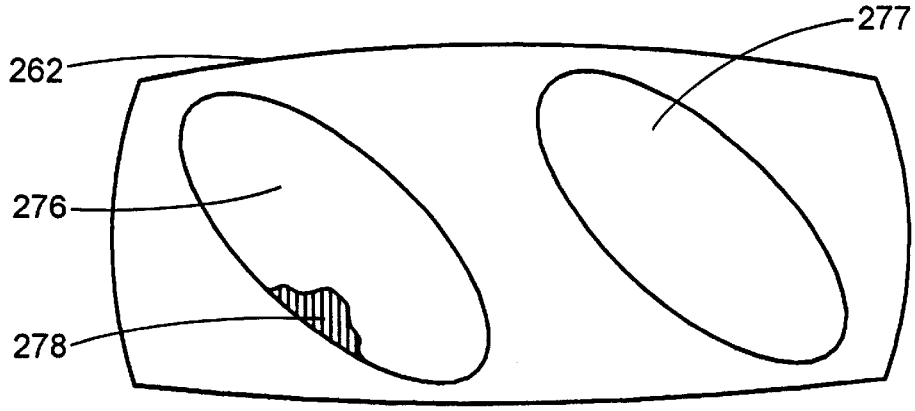
FIG. 7*c* is a partially cut away top view of the customizable inset shown in FIG. 7, constructed in accordance with the present invention.

FIG. 7*c* shows a top view of the 2 dish flat car inset 260 with the top surface of the flat car 278 shown in a partial cut away section. The top of the unitary inset 262 shows the molded inset top with cut-away portions 276 and 277 to accept side dish plates. The dishes for side orders 265 and 266 fit snugly into the molded inset top with cut-away portions 276 and 277 to accept dishes. The unitary inset 262 provides insulation to help maintain thermal insulation for the food and helps to prevent spillage of dishes or food contents from the train as it is in motion.

Figure 8:
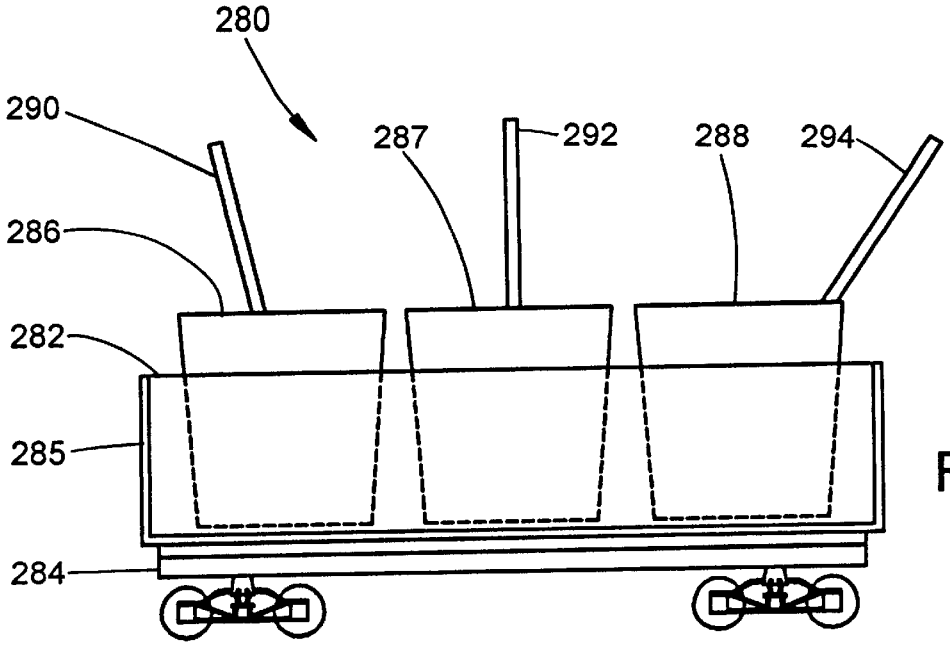
FIG. 8 is a side elevational view of another embodiment of the customizable inset in place on a flat car, holding three drink containers with straws, constructed in accordance with the present invention.

Referring now to FIG. 8, there is shown a novel 3 cup flat car inset 280. This unitary inset 282 is made of a moldable, durable, reusable, cleanable material and is specifically designed to fit inside a standard gondola car 284. The upper portion of the flat car with four walls (gondola car) 285 accommodates the unitary inset 282 with a snug fit. This view shows three cups 286, 287 and 288 for holding drinks as well as straws 290, 292 and 294 as they are held in place by the unitary inset 282. The snug fit of the standard cups prevents any unplanned movement of the cups 286, 287 and 288 during transport and the unitary inset 282 also provides insulation to help maintain the temperature of the liquid held in the cups, and keeps the gondola car free from spills.

Figure 8A:
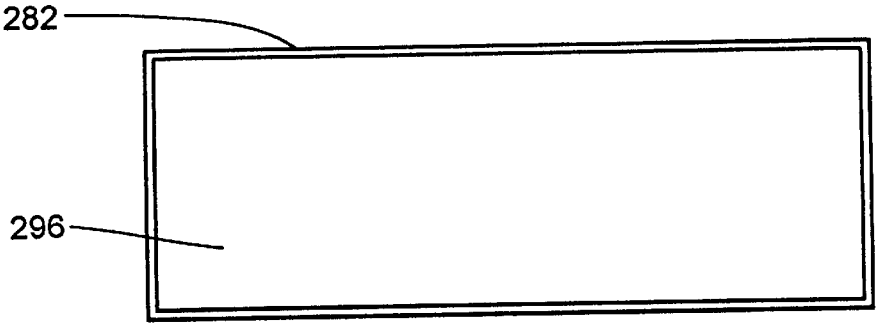
FIG. 8*a* is a bottom view of the customizable inset shown in FIG. 8, constructed in accordance with the present invention.

The molded bottom of said inset 296 to fit a flat car 284 equipped with a gondola car upper portion 285 is shown in FIG. 8*a*. The unitary inset 284 is molded on the bottom to fit snugly on the four walled gondola car upper portion 285.

Figure 8B:
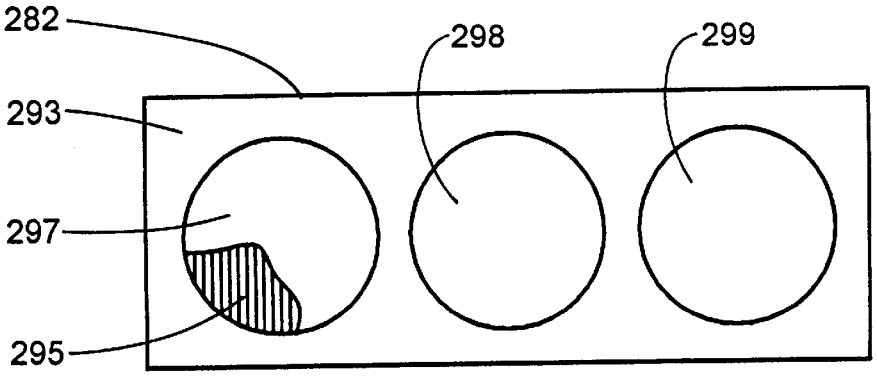
FIG. 8*b* is a partially cut away top view of the customizable inset shown in FIG. 8, constructed in accordance with the present invention.

A view of the top surface of the molded top 293 to accept 3 cups is shown in FIG. 8*b*. The cup wells 297,298 and 299 are molded to accept a standard size drinking cup. One cup well 297 has a cut away section to reveal the top surface of the flat car 295.

All of the restaurant personnel assume railroad employee titles, dress, and playing the part of railroad yard employees while also functioning in their capacity as restaurant employees. Included below is Table 1. GLOSSARY OF RAILROAD RESTAURANT TERMS which correlates proposed railroad restaurant employee nomenclature with the restaurant employee task or position.

TABLE 1

GLOSSARY OF RAILROAD RESTAURANT TERMS

| RAILROAD RESTAURANT EMPLOYEE NOMENCLATURE | RESTAURANT EMPLOYEE TASK/POSITION |
|---|---|
| Station Master | Hostess/Host/Head Greeter |
| Station Attendant | Greeter |
| Passenger | Customer |
| Station | Table |
| Conductor | Host/Hostess |
| Engineer | Waiter/Waitress |
| Yard | Train Readiness/Loaders |
| Dispatch | Train Operators |
| Gandy Dancer | Busboy |
| Lizard Scorcher | Cook |
| Railroad Boss | Manager |
| Assistant Railroad Boss | Assistant Manager |

Figure 9:
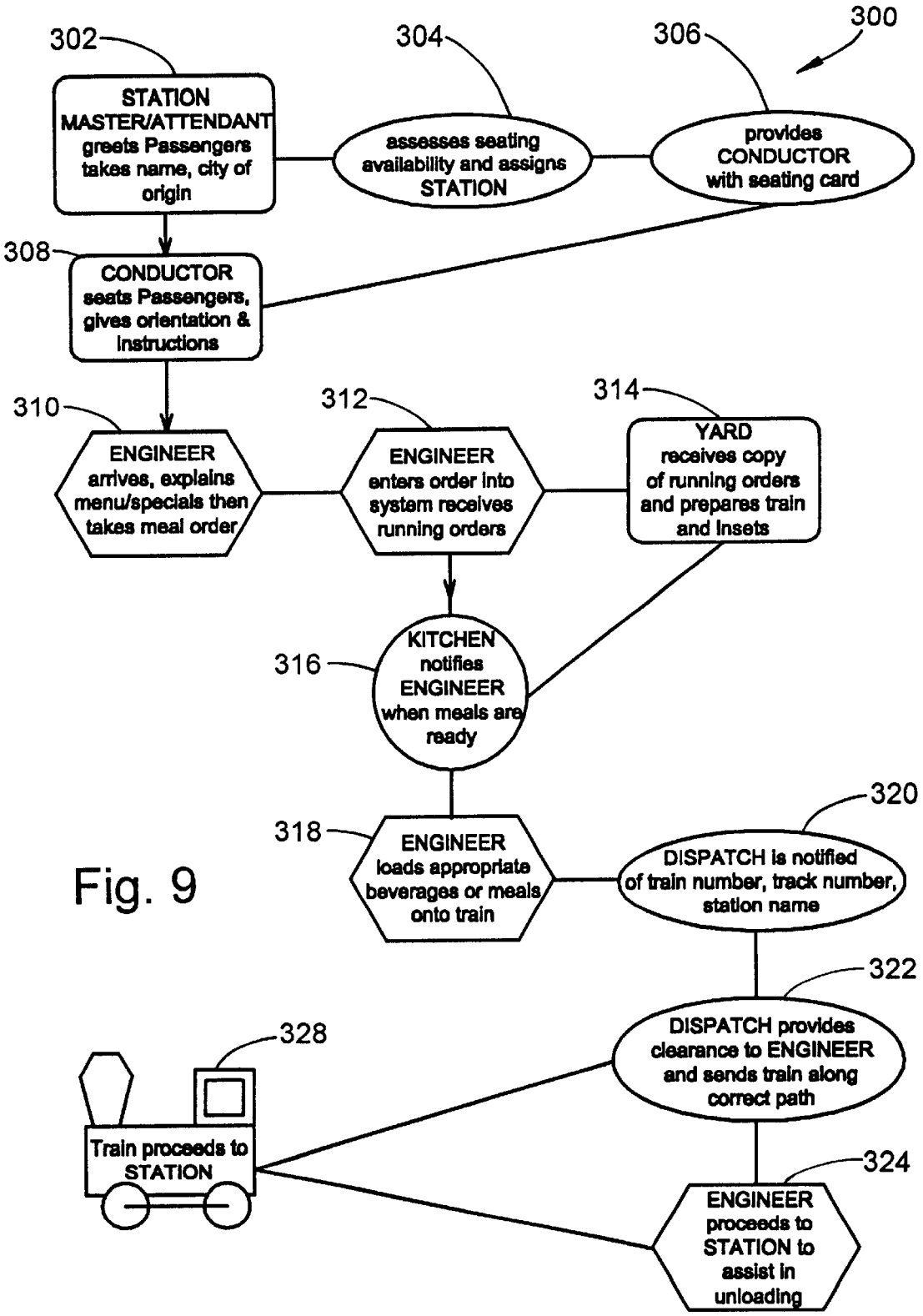
FIG. 9 is a block diagram illustrating the flow of steps taken from greeting restaurant patrons to delivering a food order via the model train delivery system, constructed in accordance with the present invention.

The responsibilities of railroad restaurant personnel and sequence of steps and events 300 as they are carried out by the restaurant personnel during interaction with diners are disclosed in FIG. 9. In step one 302, the Station Master/Attendant greets diners (Passengers) and takes their names and city of origin. The Station Master/Attendant then assess seating availability and assigns a Station in step two 304. The Station Master/Attendant then provides the Conductor with a seating card in step three 306.

The Conductor then seats the Passengers and gives orientation and instructions in step four 308. The Engineer arrives, explains the menu and specials of the day and then takes the meal order in step five 310. The Engineer proceeds to enter the order into the computer system and receives running orders in step six 312. The Yard also receives a copy of the running orders and prepares the appropriate train configuration and insets in step seven 314.

A Sample Running Food and Drink Order for the Railroad Restaurant (Running Order) is included here as Table 2. The Running Order contains all of the relevant information required by the Yard and the Engineer to carry out their responsibilities. The Sample Running Food and Drink Order defines the destination for the train, the name of the Engineer, the track number, the menu items, plate numbers, inset requirements, car requirements and the configuration of the train. This is all the necessary information for the Yard to prepare and configure trains and insets for each individual order as well as placement of the train on the correct track for delivery to a given Station in step seven 314.

The Running Order also demonstrates the usage of common railroad related terminology or names of famous railroad personalities as names for main dishes, side dishes and drinks. The Railroad theme is thus consistently used in all aspects of the menus and general environment, as well as the language, dress, mannerisms and responsibilities of the restaurant personnel.

TABLE 2

SAMPLE RUNNING FOOD AND DRINK ORDER FOR RAILROAD RESTAURANT

| | |
|---|---|
| Running Order #975 | |
| Engineer: Todd | |
| Station: Cheyenne | |
| Track #: 10 | |
| Menu Item | Plate # |
| Spaghetti Caboose | B1 |
| Choo Choo Chicken | B1 |
| Santa Fe Chicken Wrap | D1 |
| Coast Starlight | D1 |
| kids milk w/meal | C1 |
| kids milk w/meal | C1 |
| Inset requirement | (1)K2, (1)B2, (2)D1 |
| Car requirement | (3) Flatcars, (1) Gondola |
| Train configuration: | |
| 1 Engine, 3 flat cars, 1 gondola, 1 caboose | |

The Kitchen notifies the Engineer when meals are ready in step eight 316 and in step nine 318, the Engineer loads the appropriate beverages or meals onto trains that have been prepared by the Yard in step seven 314.

Dispatch is notified of the train number, track number, and station name in step ten 320. Dispatch then provides clearance to the Engineer and sends the train along the correct path in step eleven 322. The engineer proceeds to the Station to assist in unloading in step twelve 324 and the Train proceeds to the Station along the predetermined route in step thirteen 328.

It should be understood, however, that even though these numerous characteristics and advantages of the invention have been set forth in the foregoing description, together with details of the structure and function of the invention, the disclosure is illustrative only, and changes may be made in detail, especially in matters of shape, size, chemistry and arrangement of parts within the principal of the invention to the full extent indicated by the broad general meaning of the terms in which the appended claims are expressed.

What is claimed is:

1. A restaurant food delivery system comprising:

(a) a kitchen area for food preparation;

(b) seating areas for restaurant patrons, having a plurality of tables;

(c) one or more model trains capable of locomotion via electrical power including a locomotive, one or more flat cars, one or more gondola cars and customized insets attachable to said flat cars or gondola cars, corresponding to a multiplicity of various sized dishes and cups making up said food orders;

(d) a model train track network having track lines with sidings running from said kitchen area to said patron seating areas to permit the delivery of food orders, including a train-yard like staging area where numerous tracks converge, having a shelving system below said staging area permitting the storage and rapid deployment of said numerous customized food delivery insets to facilitate the rapid and accurate combining and loading of at least two food orders simultaneously;

(e) controlling means for the accurate delivery of at least two food orders simultaneously, whereby said controlling means directs food orders to the correct patron seating area, thereby accurately delivering said food order to the correct table for patron consumption; and (f) means for accommodating numerous food orders on said model train for food delivery, having the capacity to route numerous meals to numerous tables simultaneously, including said one or more flat cars and one or more gondola cars and said customized insets attachable to said flat cars or gondola cars, corresponding to a multiplicity of various sized dishes and cups making up said food orders, whereby said food delivery trains return to said staging area without hindering other food delivery trains via said sidings.

2. The restaurant food delivery system according to claim 1, wherein said patron seating areas include discreet seating area modules, including a plurality of tables all of which are accessible by model train track, whereby a model train bearing said food order is transported from said kitchen area and directed to said tables for the delivery of food orders.

3. The restaurant food delivery system according to claim 2, wherein said kitchen area and seating areas are housed in a round restaurant building, whereby said seating area modules are arranged in such a fashion as to radiate out from a central point within the round restaurant building.

4. The restaurant food delivery system according to claim 3, wherein said round restaurant building also houses a railroad theme oriented restaurant, railroad theme entertainment facilities, railroad theme museums and displays, and railroad working models for the entertainment and enjoyment of said restaurant patrons.

5. The restaurant food delivery system according to claim 4, wherein said railroad theme oriented restaurant, railroad theme entertainment facilities, railroad theme museums and displays, and railroad working models for the entertainment and enjoyment of said restaurant patrons, includes restaurant employees assuming railroad employee titles, dress, and playing the part of railroad yard employees while also functioning in their capacity as restaurant employees.

6. The restaurant food delivery system according to claim 1, wherein said controlling means includes model train and model train track controlling devices including electric sensors for detecting and reporting train location, and electronic switches for directing train movement.

7. The restaurant food delivery system according to claim 6, wherein said model train and model train track controlling devices including electric sensors for detecting and reporting train location, and electronic switches for directing train movement, is microprocessor controlled.

8. The restaurant food delivery system according to claim 6, wherein said model train and model train track controlling devices including electric sensors for detecting and reporting train location, and electronic switches for directing train movement, is manually controlled.

9. The restaurant food delivery system according to claim 1, wherein said means for accommodating numerous food orders on said model train for food delivery, including one or more flat cars and one or more gondola cars and customized insets attachable to said flat cars or gondola cars, corresponding to a multiplicity of various sized dishes and cups making up said food orders, includes insulated insets which allow for the transport of food entry plates, one or more side order dishes and one or more drink containers, whereby said insets attach firmly to said flat cars or said gondola cars and provide cavities to accept dishes and cups in such a way as to support, protect and insulate the food order during delivery to patrons tables.

10. The restaurant food delivery system according to claim 9, wherein said customized insets are stored in an area facilitating the rapid and accurate combining and loading of food orders onto said model train flat cars and gondola cars, whereby said combined and loaded food orders are efficiently and accurately transported to the correct patron seating area and tables for patron entertainment and consumption.

11. The restaurant food delivery system according to claim 1, wherein said model train track network having track lines running from said kitchen area to said patron seating areas to permit the delivery of food orders, includes access corridors having corridor access doors to allow rapid and discreet maintenance and repair of said model train track network.

12. The restaurant food delivery system according to claim 7, wherein said microprocessor controlled train movement is capable of coordinating and moving at least two discreet locomotive and car combination trains, simultaneously on said model train track network having preconfigured track lines with sidings.

13. The restaurant food delivery system according to claim 10, wherein said area facilitating the rapid and accurate combining and loading of food orders includes two such areas in each restaurant, whereby each of said facilitation areas functions as a train-yard and services one half of the restaurant food orders, and further whereby each of said facilitation areas is capable of loading and unloading at least two discreet locomotive and car combination trains, simultaneously on said model train track network having preconfigured track lines with sidings.

14. A round building structure which houses a railroad theme restaurant and model train food delivery system comprising:

(a) a kitchen area for food preparation;

(b) seating areas for restaurant patrons, having a plurality of tables;

(c) one or more model trains capable of locomotion via electrical power including a locomotive, one or more flat cars, one or more gondola cars and customized insets attachable to said flat cars or gondola cars, corresponding to a multiplicity of various sized dishes and cups making up said food orders;

(d) a model train track network having track lines with sidings running from said kitchen area to said patron seating areas to permit the delivery of food orders, including a train-yard like staging area where numerous tracks converge, having a shelving system below said staging area permitting the storage and rapid deployment of said numerous customized food delivery insets to facilitate the rapid and accurate combining and loading of at least two food orders simultaneously;

(e) controlling means for the accurate delivery of at least two food orders simultaneously, whereby said controlling means directs food orders to the correct patron seating area, thereby accurately delivering said food order to the correct table for patron consumption; and (f) means for accommodating numerous food orders on said model train for food delivery, having the capacity to route numerous meals to numerous tables simultaneously, including said one or more flat cars and one or more gondola cars and said customized insets attachable to said flat cars or gondola cars, corresponding to a multiplicity of various sized dishes and cups making up said food orders, whereby said food delivery trains return to said staging area without hindering other food delivery trains via said sidings.

15. The method for making a railroad theme restaurant with model train food delivery system, comprising the steps of:

(a) providing a kitchen area for food preparation;

(b) providing seating areas for restaurant patrons, having a plurality of tables;

(c) providing one or more model trains capable of locomotion via electrical power including a locomotive, one or more flat cars, one or more gondola cars and customized insets attachable to said flat cars or gondola cars, corresponding to a multiplicity of various sized dishes and cups making up said food orders;

(d) providing a model train track network having track lines with sidings running from said kitchen area to said patron seating areas to permit the delivery of food orders, including a train-yard like staging area where numerous tracks converge, having a shelving system below said staging area permitting the storage and rapid deployment of said numerous customized food delivery insets to facilitate the rapid and accurate combining and loading of at least two food orders simultaneously;

(e) providing controlling means for the accurate delivery of at least two food orders simultaneously, whereby said controlling means directs food orders to the correct patron seating area, thereby accurately delivering said food order to the correct table for patron consumption; and (f) means for accommodating numerous food orders on said model train for food delivery, having the capacity to route numerous meals to numerous tables simultaneously, including said one or more flat cars and one or more gondola cars and said customized insets attachable to said flat cars or gondola cars, corresponding to a multiplicity of various sized dishes and cups making up said food orders, whereby said food delivery trains return to said staging area without hindering other food delivery trains via said sidings.

16. The method for making a railroad theme restaurant with model train food delivery system according to claim 15, wherein said step of providing said controlling means includes providing model train and model train track controlling devices including electric sensors for detecting and reporting train location, and electronic switches for directing train movement and further wherein said model train and model train track controlling devices including electric sensors for detecting and reporting train location, and electronic switches for directing train movement, is microprocessor controlled.

17. The method for making a railroad theme restaurant with model train food delivery system according to claim 15, wherein said step of providing said controlling means includes providing model train and model train track controlling devices including electric sensors for detecting and reporting train location, and electronic switches for directing train movement and further wherein said model train and model train track controlling devices including electric sensors for detecting and reporting train location, and electronic switches for directing train movement, is manually controlled.

18. The method for making a railroad theme restaurant with model train food delivery system according to claim 15, wherein said step of providing means for accommodating numerous food orders on said model train for food delivery, including one or more flat cars and one or more gondola cars and customized insets attachable to said flat cars or gondola cars, corresponding to a multiplicity of various sized dishes and cups making up said food orders, includes providing insulated insets which allow for the transport of food entry plates, one or more side order dishes and one or more drink containers, whereby said insets attach firmly to said flat cars or said gondola cars and provide cavities to accept dishes and cups in such a way as to support, protect and insulate the food order during delivery to patrons tables.

19. The method for making a railroad theme restaurant with model train food delivery system according to claim 18, wherein said step of providing said customized insets includes providing an area for storing said insets for the purpose of facilitating the rapid and accurate combining and loading of food orders onto said model train flat cars and gondola cars, whereby said combined and loaded food orders are efficiently and accurately transported to the correct patron seating area and tables for patron entertainment and consumption.

20. The method for making a railroad theme restaurant with model train food delivery system according to claim 15, wherein said step of providing seating areas for restaurant patrons, having a plurality of tables includes providing a railroad theme oriented restaurant, railroad theme entertainment facilities, railroad theme museums and displays, and railroad working models for the entertainment and enjoyment of said restaurant patrons, including providing restaurant employees assuming railroad employee titles, dress, and playing the part of railroad yard employees while also functioning in their capacity as restaurant employees.

21. The method for making a railroad theme restaurant with model train food delivery system according to claim 15, wherein said step of providing a kitchen area and said step of providing said seating areas, include providing said kitchen area and seating areas housed in a round restaurant building, whereby said seating area modules are arranged in such a fashion as to radiate out from a central point within the round restaurant building, and said seating areas are services by said provided model train network for the purpose of delivering food orders to said seating areas.

22. The method for making a railroad theme restaurant with model train food delivery system according to claim 15, wherein said step of providing said model train track network having track lines running from said kitchen area to said patron seating areas to permit the delivery of food orders, includes providing access corridors having corridor access doors to allow rapid and discreet maintenance and repair of said model train track network.

* * * * *